US007810679B2

(12) United States Patent
Wauters et al.

(10) Patent No.: US 7,810,679 B2
(45) Date of Patent: Oct. 12, 2010

(54) BEER DISPENSING SYSTEM WITH GAS PRESSURE RESERVOIR

(75) Inventors: Albert W. Wauters, Destelbergen (BE); Ian Anderson, Burwell (GB); Edward P. Duffy, Royston (GB)

(73) Assignee: Anheuser-Busch InBev S.A., Brussels (BE)

( * ) Notice: Subject to any disclaimer, the term of this patent is extended or adjusted under 35 U.S.C. 154(b) by 1266 days.

(21) Appl. No.: 10/536,974

(22) PCT Filed: Nov. 25, 2003

(86) PCT No.: PCT/IB03/05399

§ 371 (c)(1),
(2), (4) Date: Dec. 23, 2005

(87) PCT Pub. No.: WO2004/050537

PCT Pub. Date: Jun. 17, 2004

(65) Prior Publication Data

US 2006/0138177 A1 Jun. 29, 2006

(30) Foreign Application Priority Data

Nov. 29, 2002 (GB) ..... 0227930.5
Nov. 29, 2002 (GB) ..... 0227931.3

(51) Int. Cl.
*B65D 83/00* (2006.01)

(52) U.S. Cl. ..... 222/399; 222/95; 222/105; 222/129.1; 222/386.5; 222/396; 222/400.7; 222/401

(58) Field of Classification Search ..... 222/95, 222/105, 146.6, 183, 386.5, 389, 401, 399, 222/394, 396, 387, 129.1
See application file for complete search history.

(56) References Cited

U.S. PATENT DOCUMENTS 103,498 A * 5/1870 Pohlmann ..... 222/386.5

(Continued)

FOREIGN PATENT DOCUMENTS

EP 0 389 191 9/1990
EP 1097899 A1 5/2001

(Continued)

*Primary Examiner*—Frederick C. Nicolas
(74) *Attorney, Agent, or Firm*—Levy & Grandinetti

(57) ABSTRACT

A home beer dispensing apparatus has a keg having a self-contained bag filled with a beer and a pressure system. The pressure system creates a pressurized air space between the keg inner walls and the bag to assist in the dispensing of the beer. The pressure system has a keg one-way air valve mounted to a top wall of the keg to permit entry of pressurized air into the keg. The pressure system has a pressure reservoir mounted in the dispensing apparatus outside the keg and in fluid flow communication with the keg one-way valve. The reservoir stores a charge of pressurized air and supplies at least a portion of this charge to the keg through the keg air valve when the dispensing apparatus is operated to dispense the beer. The reservoir provides a reserved charge of pressurized gas that is on hand to reduce dampening pressure fluctuations during beer dispensing which can result in beer frothing, especially during the early stages of beer dispensing when the air head space in the keg is small. Further, the apparatus may also have a pressure sensing system adapted to measure time rate of pressure change in the keg. The apparatus has a signaling device responsive to the time rate of pressure change in the keg to produce a signal related to volume of beer remaining in the bag. Preferably, the signal is displayed visually on the dispensing apparatus.

11 Claims, 4 Drawing Sheets

U.S. PATENT DOCUMENTS

| | | | | | |
|---|---|---|---|---|---|
| 3,233,779 | A | * | 2/1966 | Cornelius | 222/61 |
| 3,244,326 | A | * | 4/1966 | Bull, Jr. | 222/61 |
| 3,434,632 | A | * | 3/1969 | Batrow | 222/400.5 |
| 3,519,167 | A | * | 7/1970 | Wlodzimierz | 222/82 |
| 4,120,425 | A | * | 10/1978 | Bethurum | 222/146.6 |
| 4,162,030 | A | * | 7/1979 | Capra et al. | 222/95 |
| 4,264,019 | A | * | 4/1981 | Roberts et al. | 222/95 |
| 4,763,818 | A | * | 8/1988 | Stefano et al. | 222/209 |
| 4,921,135 | A | * | 5/1990 | Pleet | 222/82 |
| 5,199,609 | A | * | 4/1993 | Ash, Jr. | 222/94 |
| 5,240,144 | A | * | 8/1993 | Feldman | 222/82 |
| 5,251,787 | A | * | 10/1993 | Simson | 222/95 |
| 5,383,576 | A | * | 1/1995 | Richter et al. | 222/105 |
| 5,634,501 | A | * | 6/1997 | Walshe | 141/92 |
| 6,375,048 | B1 | | 4/2002 | van der Meer et al. | 222/396 |
| 6,454,131 | B1 | * | 9/2002 | Van Der Meer et al. | 222/95 |

FOREIGN PATENT DOCUMENTS

| | | |
|---|---|---|
| GB | 1032825 | 3/1963 |
| GB | 1102697 | 2/1968 |
| GB | 2270124 A | 3/1994 |
| NL | 8502184 | 3/1987 |
| NL | 1019526 | 3/2003 |
| WO | 95/20540 | 8/1995 |

* cited by examiner

BEER DISPENSING SYSTEM WITH GAS PRESSURE RESERVOIR

The Applicants claim priority to International Application Number PCT/IB2003/005399, filed on Nov. 25, 2003, which claims priority to British Application Numbers GB 0227930.5 and 0227931.3, filed on Nov. 29, 2002.

FIELD OF THE INVENTION

The present invention relates to an alcohol beverage dispensing beverage apparatus having a pressure system for use in dispensing an alcohol beverage and in particular, relates to a home beer dispensing apparatus having a gas pressure reservoir. Further, it relates to an alcohol beverage dispensing apparatus having a pressure sensing system and in particular, relates to a home beer dispensing apparatus having a pressure sensing system that determines volume of beer remaining in the apparatus.

BACKGROUND OF THE INVENTION

Beer dispensing apparatus are known in the art for dispensing of draft beer in taverns and the like. Typically, the beer is dispensed from a keg under pressure from $CO_2$ tanks forming part of the pressure system. Such draft beer dispensers are utilized in taverns where the large volumes of beer are dispensed everyday and the taverns have refrigerated rooms to store the kegs.

This is not the case for a domestic or home beer dispensing apparatus that is adapted to sit on a countertop in a kitchen where space is at a premium. Further, the domestic beer dispensing system typically stores the beer in a bag contained in a keg and pressure is applied between the keg inner walls and the bag to assist in the dispensing of beer from the keg.

Due to limited countertop space requirements, there is a requirement in the home beer dispensing apparatus to reduce compressor size and still maintain sufficient pressure within the keg to properly effect the dispensing of beer from the keg. Further there is a need to provide sufficient pressure to reduce dampening pressure fluctuations during dispensing which can result in beer frothing, especially during the early stages of dispensing beverage where the head pressure in the keg is minimal.

Moreover, it is difficult to determine the volume of beer remaining in a home beer dispensing system utilizing a keg having a self-contained bag of beer. This is because the keg does not provide for a visual indication of the amount of beer left in the keg. Further, once the keg is placed inside the beer dispensing system, it is no longer readily accessible to the consumer.

SUMMARY OF THE INVENTION

It is an object of the present invention to provide an alcohol beverage dispenser wherein sufficient pressure is maintained to reduce dampening pressure fluctuations during alcohol dispensing, especially during the early stages of alcohol dispensing.

It is a further object of the present invention to provide an alcohol beverage dispensing apparatus which reduces compressor rating.

It is a further object of the present invention to provide an alcohol beverage dispenser having a keg with a self-contained bag containing the beverage where the apparatus produces a signal indicative of the volume of beer remaining in the bag.

The present invention relates to an alcohol beverage dispensing apparatus comprising a keg having a self-contained bag filled with an alcohol beverage. Preferably, the beverage is beer. The dispensing apparatus has a pressure system adapted to maintain a gas pressure in the keg against the bag to assist in the dispensing of the beverage from the dispensing apparatus. The pressure system has a pressure reservoir that stores a charge of pressurized gas which is preferably air. The reservoir is mounted in the apparatus outside the keg and in fluid flow communication with the interior of the keg. The reservoir is adapted to transmit at least a portion of its charge of pressurized gas into the keg when the dispensing apparatus is operated to dispense the beverage.

By providing a reserved charge of pressurized gas, a sufficient supply of gas is on hand to reduce dampening pressure fluctuations during alcohol dispensing which can result in beer frothing, especially during the early stages of alcohol dispensing when the air head space in the keg is small.

Preferably, the pressure system has a gas compressor connected with the pressure reservoir for charging the pressure reservoir with pressurized gas prior to the dispensing apparatus being operated to dispense the beverage. Additionally, the compressor may continue to be operated to charge the reservoir during dispensing of the beverage from the dispensing apparatus and, if necessary, after the dispensing cycle is completed. The compressor continues to change the pressure in the reservoir until it reaches a predetermined pressure level. As a result, the compressor rating is reduced.

In a preferred embodiment, to economize on space requirements in the dispensing apparatus, where the keg has a curved side wall, the pressurized reservoir has a curved wall adapted to surround in adjacent relation at least a portion of a curved side wall of the keg.

Preferably, the pressure system comprises a pressure switch connected in fluid communication between the pressure reservoir and a gas valve in the keg. The pressure switch enables pressurized gas to flow from the reservoir into the keg through the keg gas valve when beverage is dispensed from the bag. It is envisaged that this switch may form part of the keg gas valve, may be part of an exit or exhaust valve for the reservoir, or may be in a tube or tap interconnecting the reservoir with the keg gas valve.

In a second embodiment, the apparatus has a pressure sensing system adapted to determine the time rate of pressure change in the keg. The apparatus has a signaling device responsive to the time rate of pressure change in the keg to produce a signal related to volume of beverage remaining in the bag.

Advantage is found with this embodiment of the present invention because during a normal beer dispense cycle, the time rate of change in pressure in the keg varies as the volume of beer in the keg diminishes. As a result this property of pressure change in the keg is utilized by the present invention to provide a signal indicative of the volume of beverage remaining in the keg. Preferably, the beverage is beer and the signal is displayed visually on a face of the dispensing apparatus. Alternatively, an audio signal may be generated.

In one preferred aspect of this embodiment of the present invention, the pressure sensing system measures time rate of change of pressure drop in the keg during a normal beverage dispense cycle and the signaling device in response to the time rate of pressure drop produces the signal relating to volume of beverage remaining in the bag.

In another preferred aspect of this embodiment of the present invention, the pressure sensing system measures time rate of change of pressure rise in the keg subsequent to a normal dispense cycle and the signaling device is responsive to the time rate of pressure rise to produce the signal relating to volume of beverage remaining in the bag.

Preferably, the pressure sensing system has first and second pressure sensors respectively for sensing higher and lower predetermined values of pressure in the keg and respectively generating first and second pressure signals. The pressure sensing system has a controller for determining the time interval between the generation of the first and second signals to determine either the time rate of pressure drop, or the time rate of pressure rise, in the keg.

Preferably, the first predetermined value of pressure is less than maximum pressure normally maintained in the keg by the pressure system and the second predetermined value of pressure is greater than minimum pressure reached in the keg during the normal dispense cycle.

Preferably, the first and second pressure sensors are mounted in the dispensing apparatus in pressure sensing contact with the keg outer wall to sense pressure on the keg that is related to the pressure in the keg.

In accordance with the first embodiment of the present invention there is provided an alcohol beverage dispensing apparatus comprising a keg having a self-contained bag filled with an alcohol beverage. The dispensing apparatus comprises a pressure system adapted to maintain a gas pressure in the keg against the bag to assist in the dispensing of the beverage from the dispensing apparatus. The pressure system comprises a keg gas valve mounted to the keg to permit entry of pressurized gas into the keg and a pressure reservoir mounted in the apparatus outside the keg. The reservoir is in fluid flow communication with the keg gas valve. The pressure reservoir stores a charge of pressurized gas and is adapted to supply at least a portion of the charge of pressurized gas into the keg through the keg gas valve when the dispensing apparatus is operated to dispense the beverage.

In accordance with the second embodiment of the present invention there is provided an alcohol beverage dispensing apparatus comprising a keg having a self-contained bag filled with an alcohol beverage. The apparatus comprises a pressure system adapted to maintain gas pressure in the keg against the bag to assist in the dispensing the beverage from the dispensing apparatus. The apparatus has a dispensing device adapted to dispense beer from the bag and lower gas pressure in the keg during a normal beverage dispense cycle. The apparatus has a pressure sensing system adapted to measure time rate of pressure change in the keg and a signaling device responsive to the time rate of pressure change in the keg to produce a signal related to volume of beverage remaining in the bag.

BRIEF DESCRIPTION OF THE DRAWINGS

For a better understanding of the nature and objects of the present invention reference may be had to the accompanying diagrammatic drawings in which.

DETAILED DESCRIPTION OF THE INVENTION

Figure 1:
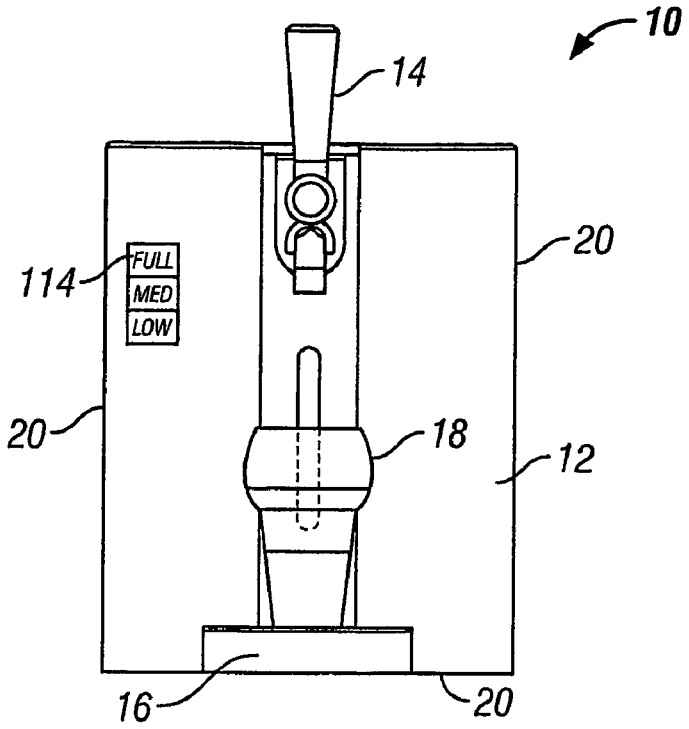
FIG. 1 is a front elevation view of a home beer dispensing apparatus in accordance with the present invention.
Figure 2:
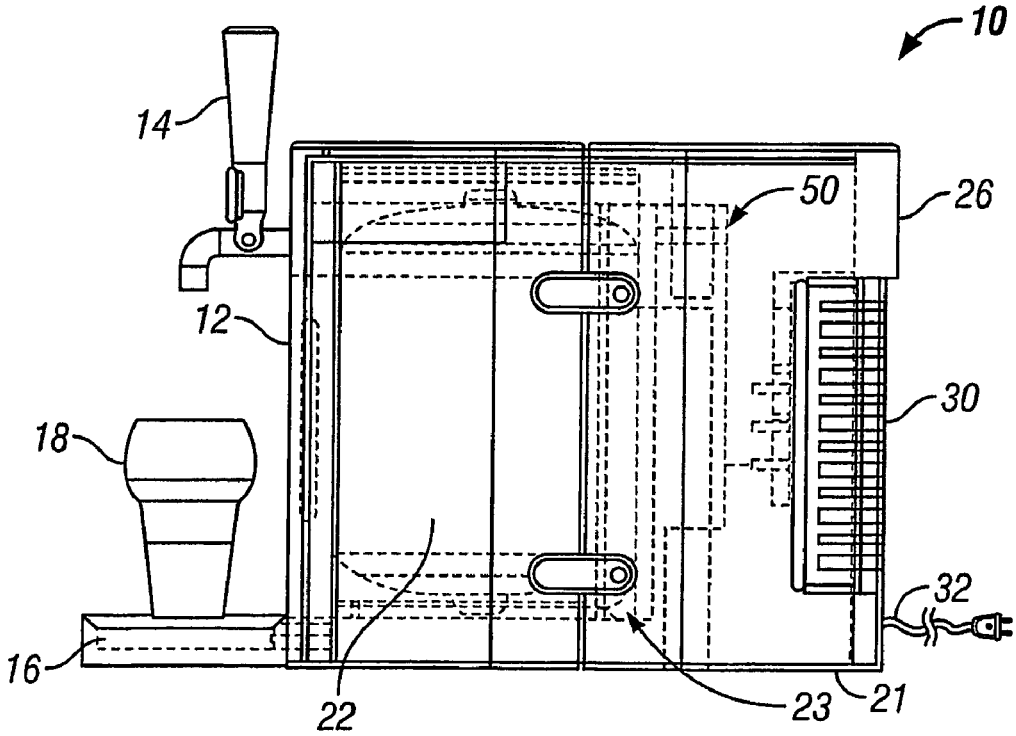
FIG. 2 is a side elevation view of the home beer dispensing apparatus.

Referring to FIGS. 1 and 2 there is shown a home beer dispensing apparatus, appliance or unit 10. The dispensing apparatus 10 is primarily intended for use in domestic kitchens but may also be used in utility rooms, garages, domestic bars, caravans etc. While the preferred embodiment relates to dispensing beer, alternatively carbonated solutions or other alcohol beverages may be dispensed by apparatus 10.

The home beer dispensing apparatus 10 has a front wall 12 and a dispensing tap 14 protruding forward of the front wall 12. A drip tray 16 also protrudes forward of the front wall 12 and is adapted to support an open glass container 18 below the dispensing tap 14. The home beer dispensing apparatus 10 further has a base 21 adapted to rest on a counter top in a kitchen. The front wall 12 is formed as an extension of two pivoting side walls 20 which may be moved between closed and open positions to allow the keg 22 (see FIG. 2 in broken lines) to be inserted into the housing of the home beer dispensing apparatus 10. The housing of the home beer dispensing apparatus 10 further includes a top wall 24 and a rear wall 26. The rear wall 26 has a grill 30 that permits for air circulation within the home beer dispensing apparatus 10. An electrical cord 32 extends through the rear wall 26 of the apparatus 10 to provide a connection into a main electrical supply to supply electrical power to the electrical components housed within the dispensing apparatus 10. Alternatively, a 12 Volt DC supply input may be used.

The dispensing apparatus 10 has a cooling system 23 located behind and below keg 22 that is adapted to cool the keg 22 of beer when placed in dispensing apparatus 10. The dispensing apparatus 10 also dispenses the beer by providing a pressurized air supply 50.

Figure 3:
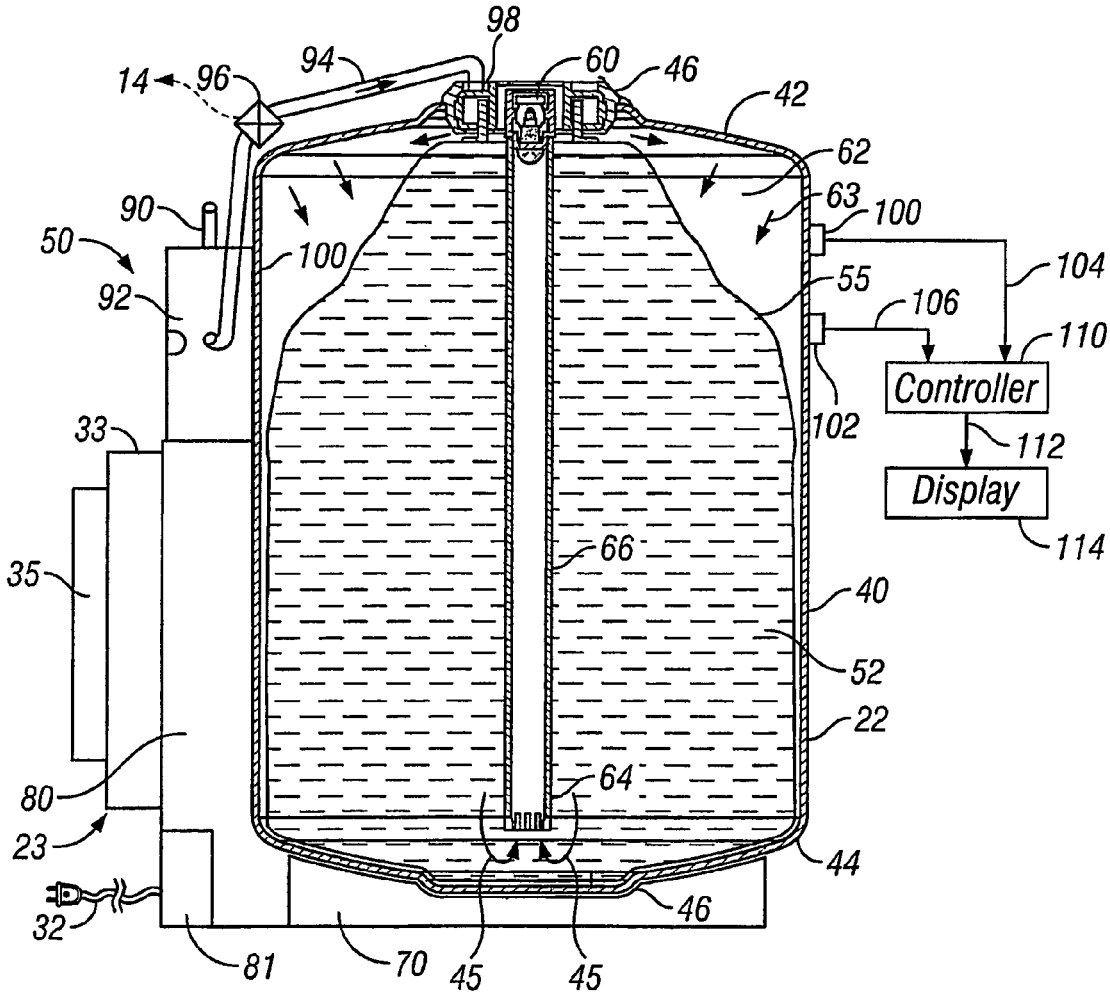
FIG. 3 is a side sectional view of the keg shown inside the beer dispensing apparatus of FIG. 2 illustrating the pressurizing system of the present invention and the pressure sensing system of the present invention.
Figure 4:
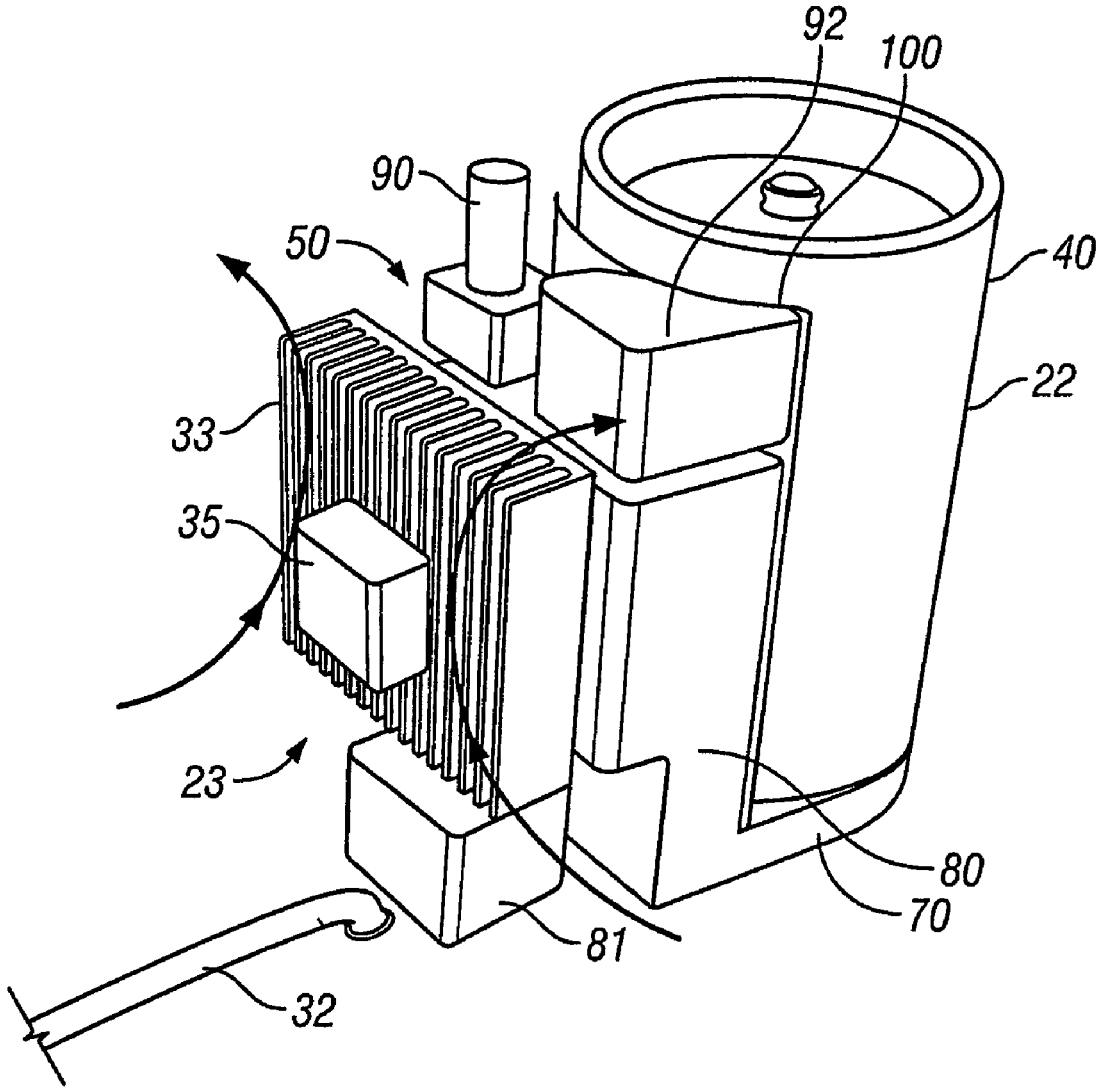
FIG. 4 is a perspective view of the interior of the home beer dispensing apparatus.

Referring to FIGS. 2, 3 and 4, cooling of the keg 22 within the beer dispensing apparatus 10 is accomplished by a cooling system 23 comprising cooling plate 70 in mechanical and heat transfer contacting relation with a bottom portion 44 of the keg 22 for extracting heat from the beer 52.

The cooling apparatus further includes a Peltier thermoelectric device 80 mounted in mechanical and thermal heat transfer contacting relation with the cooling plate 70. The Peltier thermoelectric device 80 is connected through a suitable leads and transformer 81 to the power supply line or cord 32 so that a voltage is applied across the Peltier thermoelectric device 80. The voltage drop across this Peltier cooling device 80 results in a thermal difference being generated across the device whereby surface 82 of Peltier device 80 is cooler than hot surface 84. As a consequence, heat is extracted from the cooling plate 70 which in turn extracts heat from the keg 22. The Peltier thermoelectric device 80 provides a low rate of continuous cooling. Active heat extraction is provided by heat sink 33 and cooling fan 35.

Referring to FIG. 3, the keg 22 of the present invention is shown in more detail. The keg 22 has a general cylindrical shape with side walls 40 and a top wall or top portion 42 and a bottom wall or bottom portion 44. Both top wall 42 and bottom wall 44 are curved upwardly from the central portion of the keg 22 and are provided with a raised annular collar 46. The collars 46 provide additional support for the keg 22. Mounted within the keg walls 40, 42 and 44 is a plastic bag 55 for containing alcohol beverage which in the preferred embodiment is beer 52.

As shown in FIG. 3, the bag 55 almost completely fills the keg 22 and an air head space 62 is present. This illustration represents a condition where some of the beer 52 has already been dispensed from bag 55 and the bag 60 is partially deflated and beer 52 is under pressure. Arrows 63 represent air pressure within keg 22 acting against bag 55 to facilitate dispensing of beer 52.

It should be understood that initially the bag 55 lines the interior walls of keg 22 and is completely filled with beer 52 providing little or no head space 62. As the beer 52 is dispensed from the keg 22, an air pressure 63 is established between the walls of the bag 55 and the inside surfaces of walls 40, 42 and 44 of the keg. This head space 62 continues to grow as beer is dispensed until the beer is dispensed from bag 55.

The top portion 42 and collar 46 located in the top portion 42 of keg 22 has a keg beer dispensing valve 60 extending through the top collar 46. The valve 60 is connected to the tap 14 of the beer dispensing apparatus 10 by a tube or tap connection (not shown) extending from the keg dispensing device 60. The dispensing device 60 has a hollow dip tube 66 that extends into the keg 22 within bag 55 so as to provide a remote opened end 64 adjacent the bottom portion 44 of the keg for drawing beer 52 from the keg adjacent the bottom portion 44 of the keg 22 as represented by arrows 45. Beer 52 is drawn through opening 64, up hollow tube 66, and out through valve 60 to the tap 14 (FIG. 1).

Referring to FIGS. 3 and 4, the air pressure as indicated by arrows 63 within the keg 22 is provided by the air pressure system 50. The air pressure system 50 is shown to comprise a compressor or pump motor 90, a pressure reservoir 92, tubing or conduit 94, a pressure switch 96, and a one-way reed air valve 98.

The air valve 98 is a one way air valve comprising a reed type valve which permits air to flow into the space 62 between the bag 55 and the interior walls of the keg 22. This valve 98 is mounted to the keg and forms part of an over all valve system including the beverage dispensing valve 60. The air valve 98 is located within the collar 46 of the keg in a standardized location. The valve combination 60 and 98 is mounted into the keg through the collar 46 by knocking out a face plate that otherwise extends across the collar 46. The valves 60 and 98 are mounted in sealed relation with the keg 22. The valve 98 is in fluid communication with the reservoir 92 by means of tubing 94 and pressure switch 96. Tubing 94 may form part of the tap connection (not shown) which provides a standardized fitting on valves 60 and 98. Pressure switch 96 may form part of the valve 98 or alternatively may form part of the exhaust valve or opening for the reservoir 92. Pressure switch 96 is preferably activated by the activation of the dispensing tap 14 to draw beer 52 out through dispensing tube 66 and valve 60. This is indicated graphically in FIG. 3 by the broken line extending from switch 96 with an arrow pointing towards number 14 representative of tap 14.

The reservoir 92 is located with its wall 100 located in abutting relation with an outside wall 40 of the keg 22. As shown better in FIG. 4, the wall 100 of the air reservoir 92 is curved to follow and be adjacent to the curvature of the cylindrical wall 40 of the keg 22. The placement of the reservoir 92 above the Peltier cooler 80 adjacent the keg 22 provides for economical spaced placement of the reservoir 92 in the dispensing apparatus 10.

Figure 5:
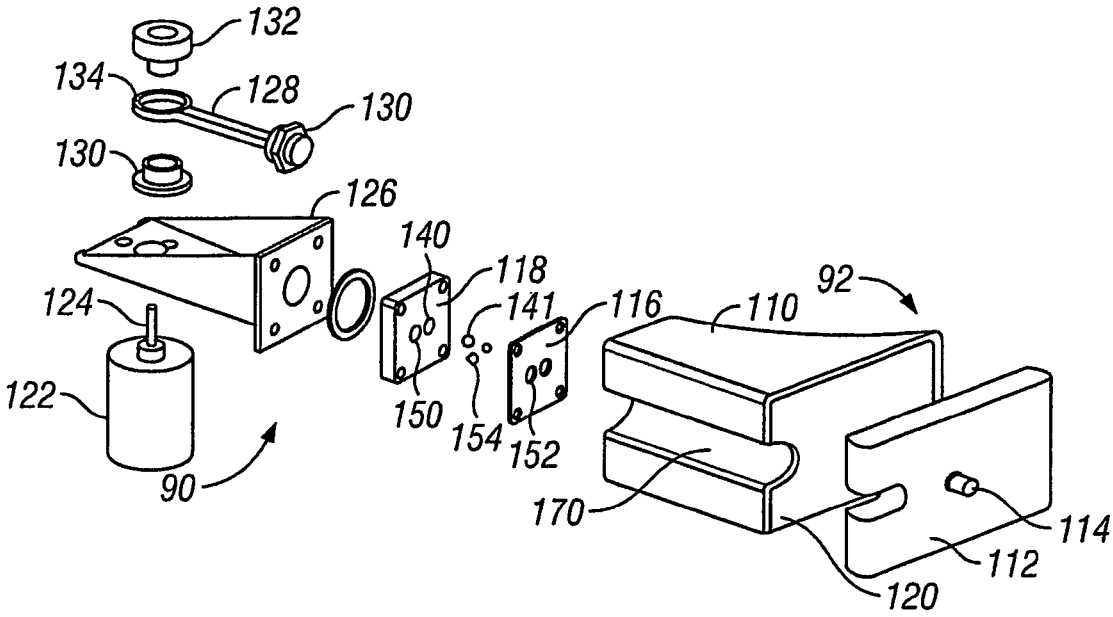
FIG. 5 is an exploded view of the component parts of the compressor and pressure reservoir utilized in the pressure system of the present invention; and, FIG. 6 is a side sectional view of the compressor.
Figure 6:
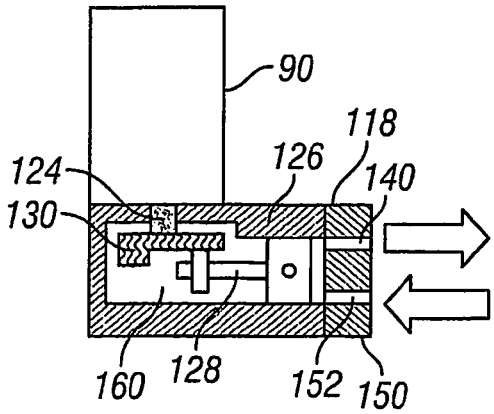

As shown in FIG. 5, the reservoir 92 comprises a main body portion 110 having an end wall 112 mounted thereto. The end wall 112 has an exit opening 114 which is connected to tubing 94. The body portion 110 also has a sealing gasket 116 and a sealing plate 118 adapted to be mounted against the opposite end of the reservoir 92. This provides an enclosed space 120 which is adapted to be charged with pressurized gas.

The pressurized gas is filled into the reservoir 92 by means of compressor 90. Compressor 90 comprises a motor 122 having a spindle 124 connected to a reciprocating piston 128. Piston 128 is connected to a cam member 130 by a head bolt 132 passing through a circular opening 134 in the reciprocating piston 128. The end of piston 128 at 130 is adapted to force air out through opening 140 in the face plate 118 and into the reservoir 92 during an out-take stroke. The opening 118 is sealed by a one way valve 140. Also provided in the face plate 118 and the sealing member 116 is another opening 150 and 152 respectively. Openings 150 and 152 also are provided with a one way valve 154 and operate to draw air in through the reciprocating piston 128 on an intake stroke. The intake air is provided along the groove 170 provided in the reservoir 92.

During operation, the compressor 90 is activated by energizing motor 90 through a suitable electrical energy supply. The compressor creates a pressure charge within the reservoir 92 which is held in the reservoir 92 by pressure switch 96. The compressor 90 is controlled to generate this charge in the reservoir 92 until a predetermined charge is sensed in the reservoir 92 or a predetermined time period of compressor operation has expired. At this time, the compressor stops operating. During a dispense cycle, the tap 14 in the apparatus 10 is activated which causes the beer 52, maintained under pressure in the keg 22, to move through open end 64 of tube 66 and out through valve 60 to the tap 14 and into the glass container 18. When the tap 14 is activated, pressure switch 96 opens to allow at least a portion of the charge of pressure to pass from reservoir 92 along tube 94 and in through air valve 98 into the space 62 between the bag 55 and keg walls 22. This creates additional pressure within head space 62 which is forced against the bag to further deflate the bag and maintain an adequate dispensing flow of the beer through the tap 14 into the glass 18 so as to prevent the beer from frothing and to reduce dampening pressure fluctuations. This is particularly the case when the head space 62 is relatively small and there is need for quick build up of pressure as represented by arrow 63 in order to effect proper dispensing of the beer.

During the dispensing operation, the compressor 90 is activated to maintain a consistent pressure to the air reservoir which is passed through the tubing 94 in the event that multiple pours of beverage are being dispensed into glass 18. After the tap 14 is turned off, the compressor 90 continues to charge the reservoir 92 until either a predetermined pressure is obtained or for a predetermined time period so that a sufficient or adequate pressure charge is once again stored in the reservoir 92.

During a normal dispense cycle wherein beer 52 is dispensed through tube 66 and tap 14 into a glass 18, the volume of beer dispensed in a normal cycle is that of a full glass of beer. This amount is assumed to be about 8 ounces. During this dispensing of beer 52 out from the bag 55, the deflation of bag 55 results in a pressure drop in the head space 62. Initially, when there is little or no head space in the keg 22, the pressure drop is relatively higher than the pressure drop that occurs when the bag is half full or even a quarter full of beer 52.

In another embodiment, the present invention provides a pair of pressure sensors 100 and 102 which are mounted in the apparatus 10 in pressure sensing relation against the side wall 40 of the keg 22. The sensors 100 and 102 are responsive to minimum and maximum predetermined values of pressure which are sensed from the side wall 40 which is representative of predetermined minimum and maximum values of pressure within the keg head space 22. It should be understood that these minimum and maximum pressures are values to which the sensors 100 and 102 are set and may not necessarily represent the minimum and maximum values of pressure change within the head space 62. The minimum and maximum pressures to which sensors 100 and 102 are set may represent threshold pressures above which the pressure in the keg 22 is to be maintained prior to a dispensing cycle and a lower pressure to which the pressure in keg head space 62 falls during a dispense cycle.

A controller 110 measures or monitors the time required for the signals 104 and 106 to be received by the controller 110. This time difference represents a time rate of pressure change within the head space 62. This time rate of pressure is output from controller 110 as a volume signal on line 112. This signal is received by a display 114 which is mounted on the outside or front surface 12 of the dispensing apparatus 20. As shown in FIG. 1, the display 114 has 3 levels of volume indication. The levels are full, medium, or low. Each of these levels represents the amount of beverage 52 contained within the bag 55. It should be understood that the amount of beverage may be displayed in additional graduated amounts, or alternatively, more than two pressure sensors may be employed.

While the preferred embodiment relates to the use of pressure sensors 100 and 102 which generate signals in response to thresholds being exceeded, it should be understood that alternatively, pressure sensor 100 may be a pressure sensor which provides an indication when a maximum value of pressure in the head space 62 has been reached and the pressure sensor 102 may provide an indication when the minimum value of pressure in the head space 62 has been obtained during each dispense cycle. However, by having the pressure sensors set at predetermined thresholds which are less than maximum and minimum pressure thresholds experienced during a normal dispensing cycle, these predetermined thresholds should be exceeded during a normal beer dispensing cycle.

In the event that half a glass of beer is dispensed, then the sensor 102 may not exceed its lower threshold to activate signal 106 and, hence, the controller 110 has no means of measuring the time difference between the maximum pressure and the minimum pressure sensed by sensors 100 and 102. During such an abnormal dispense cycle, the controller 110 is not able to generate a signal which might be faulty with respect to the amount of contents left in the keg 22.

In accordance with one preferred aspect of this embodiment of the present invention, the sensors 100 and 102 provide signals sequentially from the upper value of sensor 100 to the lower value of sensor 102 during a dispense cycle which provides a time rate of pressure drop within the head space 62. In accordance with another preferred aspect of the present invention, the sensors 100 and 102 send signals to controller 110 which represent the rate of pressure rise within the head space 62 after the dispense operation has finished and during which compressor 90 operates to increase the pressure within the head space 62. Accordingly, the controller 110 operates to measure the rate of change of pressure either due to a pressure drop during a normal dispense cycle or a pressure increase after a normal dispense cycle has occurred.

What is claimed is:

1. An alcohol beverage dispensing apparatus comprising:

a keg having a self-contained bag filled with an alcohol beverage, said keg having a curved side wall;

a pressure system adapted to maintain a gas pressure in the keg against the bag to assist in the dispensing of the beverage from the dispensing apparatus, the pressure system comprising:

a keg gas valve mounted to the keg to permit entry of pressurized gas into the keg;

a pressure reservoir having a curved wall adapted to surround in adjacent relation a portion of the curved side wall of the keg and which is mounted in the apparatus outside the keg and in fluid flow communication with the keg gas valve, the pressure reservoir storing a charge of pressurized gas and being adapted to supply at least a portion of the charge of pressurized gas into the keg through the keg gas valve when the dispensing apparatus is operated to dispense the beverage, wherein the pressure system further comprises a gas compressor connected with the pressure reservoir for charging the reservoir with pressurized gas prior to the dispensing apparatus being operated to dispense the beverage.

2. The apparatus of claim 1 wherein the gas is air.

3. The apparatus of claim 1 wherein the pressure system further comprises a pressure switch connected in fluid communication between the pressure reservoir and the keg gas valve, and the pressure switch enabling pressurized gas to flow from the reservoir into the keg through the keg gas valve when beverage is dispensed from the bag.

4. The apparatus of claim 1 wherein the compressor continues to charge the reservoir during dispensing of the beverage from the dispensing apparatus until air pressure in the pressure reservoir reaches a predetermined pressure level.

5. The apparatus of claim 1 wherein the compressor comprises a reciprocal pump adapted to draw gas into the pump on an intake stroke and adapted to force gas out of the pump during an out-take stroke.

6. The apparatus of claim 5 wherein the pump has a first one-way pump valve connected to the pump to permit gas to enter the pump and a second one-way pump valve connected to the pump to permit gas to exit the pump and remain in the pressure reservoir.

7. A home beer dispensing apparatus comprising:

a keg having a curved side wall and a self-contained bag filled with a beer;

a pressure system adapted to create a pressurized air space between the keg inner walls and the bag to assist in the dispensing of the beer from the dispensing apparatus, the pressure system comprising:

a keg one-way air valve mounted to a top wall of the keg to permit entry of pressurized air into the keg;

a pressure reservoir having a curved wall adapted to surround in adjacent relation a portion of the curved side wall of the keg and which is mounted in the apparatus outside the keg and in fluid flow communication with the keg one-way valve, the pressure reservoir storing a charge of pressurized air and being adapted to supply at least a portion of the charge of pressurized air to the keg through the keg air valve when the dispensing apparatus is operated to dispense the beverage; and, an air compressor connected with the pressurized reservoir for charging the reservoir with pressurized air.

8. The apparatus of claim 7 wherein the pressure system further comprises a pressure switch connected in fluid communication between the pressure reservoir and the keg air valve, and the pressure switch enabling pressurized air to flow from the reservoir into the keg through the keg air valve when beverage is dispensed from the bag.

9. The apparatus of claim 8 wherein the compressor continues to charge the reservoir during dispensing of the beer from the dispensing apparatus until air pressure in the pressure reservoir reaches a predetermined pressure level.

10. The apparatus of claim 7 wherein the compressor comprises a reciprocal pump adapted to draw air into the pump on an intake stroke and adapted to force air out of the pump and into the reservoir during an out-take stroke.

11. The apparatus of claim 10 wherein the pump has a first one-way pump valve connected to the pump to permit gas to enter the pump and a second one-way pump valve connected to the pump to permit gas to exit the pump and enter the pressure reservoir.

* * * * *